US006350052B1

(12) United States Patent
Storz

(10) Patent No.: US 6,350,052 B1
(45) Date of Patent: Feb. 26, 2002

(54) MANUAL ROLLING CONCRETE MIXING DEVICE

(76) Inventor: Stephen K. Storz, 347 Willow St., South Hempstead, NY (US) 11550

( * ) Notice: Subject to any disclaimer, the term of this patent is extended or adjusted under 35 U.S.C. 154(b) by 0 days.

(21) Appl. No.: 09/586,028

(22) Filed: Jun. 2, 2000

(51) Int. Cl.[7] ..... B01F 9/02

(52) U.S. Cl. ..... 366/57; 366/228; 404/131

(58) Field of Search ..... 366/53–60, 62, 366/63, 130, 219–220, 225–229, 345; 492/13; 172/122, 133, 170; 404/122, 131

(56) References Cited

U.S. PATENT DOCUMENTS 82,009 A * 9/1868 Kittredge
166,915 A * 8/1875 Copeland, Jr.
213,420 A * 3/1879 Hobson
508,157 A * 11/1893 Wilson
606,687 A * 7/1898 Seymour, Jr.
967,349 A * 8/1910 Dunham
1,088,582 A * 2/1914 Jarvis
1,104,502 A * 7/1914 Hist
1,254,935 A * 1/1918 Reimann
1,349,285 A * 8/1920 Lynch
1,411,828 A * 4/1922 Aten
1,618,564 A * 2/1927 Bell
1,924,644 A * 8/1933 Himmelberger
2,029,518 A * 2/1936 Budd et al.
2,441,392 A * 5/1948 Bresee
3,232,586 A * 2/1966 McClive
3,473,789 A * 10/1969 Dietrich
5,403,086 A * 4/1995 Lindesay
5,944,417 A * 8/1999 Shiotani

* cited by examiner

*Primary Examiner*—Charles E. Cooley

(57) ABSTRACT

A new concrete mixing device for mixing concrete as a user moves the device along a ground surface. The inventive device includes a rolling drum with one of the ends of the rolling drum having an opening into the interior of the rolling drum. The device also includes a handle member having opposite first and second ends and a pair of arms. The arms are spaced apart from each other at the first end of the handle member. Each of the arms has a mounting pin extending therefrom that face one another. The rolling drum is interposed between the arms with each of the ends of the rolling drum rotationally mounted to an associated mounting pin to permit free rotation of the rolling drum. A pair of hand grips are extended from the second end of the handle member.

11 Claims, 5 Drawing Sheets

FIG 3
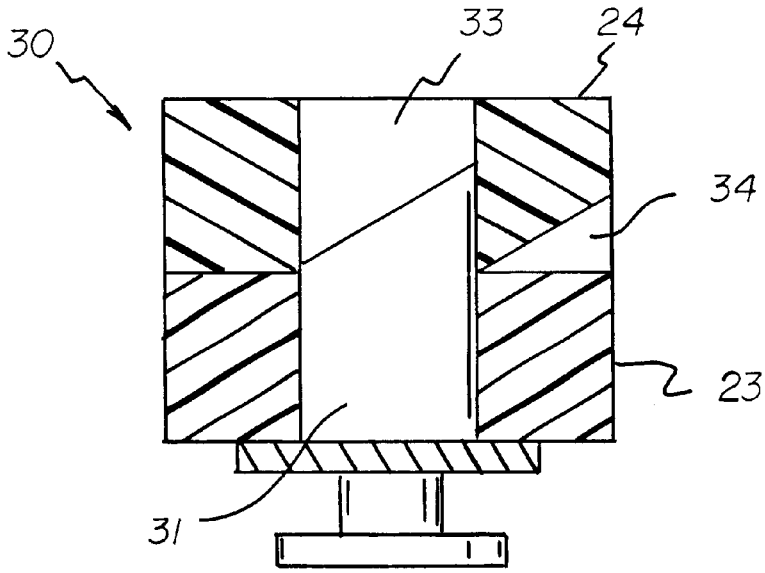
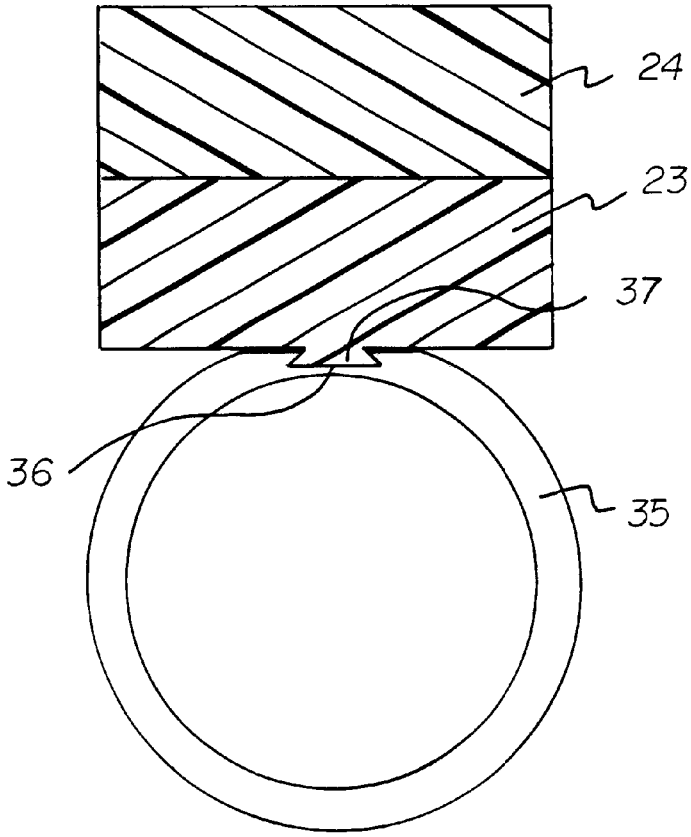
FIG 4

MANUAL ROLLING CONCRETE MIXING DEVICE

BACKGROUND OF THE INVENTION

1. Field of the Invention

The present invention relates to concrete mixers and more particularly pertains to a new concrete mixing device for mixing concrete as a user moves the device along a ground surface.

2. Description of the Prior Art

The use of concrete mixers is known in the prior art. More specifically, concrete mixers heretofore devised and utilized are known to consist basically of familiar, expected and obvious structural configurations, notwithstanding the myriad of designs encompassed by the crowded prior art which have been developed for the fulfillment of countless objectives and requirements.

Known prior art concrete mixers include U. S. Pat. No. 4,078,263; U.S. Pat. No. 5,441,341; U.S. Pat. No. 4,225,246; U.S. Pat. No. 4,223,997; U.S. Pat. No. 3,473,789; and U.S. Pat. No. Des. 246,243.

While these devices fulfill their respective, particular objectives and requirements, the aforementioned patents do not disclose a new concrete mixing device. The inventive device includes a rolling drum with one of the ends of the rolling drum having an opening into the interior of the rolling drum. The device also includes a handle member having opposite first and second ends and a pair of arms. The arms are spaced apart from each other at the first end of the handle member. Each of the arms has a mounting pin extending therefrom that face one another. The rolling drum is interposed between the arms with each of the ends of the rolling drum rotationally mounted to an associated mounting pin to permit free rotation of the rolling drum. A pair of hand grips are extended from the second end of the handle member.

In these respects, the concrete mixing device according to the present invention substantially departs from the conventional concepts and designs of the prior art, and in so doing provides an apparatus primarily developed for the purpose of mixing concrete as a user moves the device along a ground surface.

SUMMARY OF THE INVENTION

In view of the foregoing disadvantages inherent in the known types of concrete mixers now present in the prior art, the present invention provides a new concrete mixing device construction wherein the same can be utilized for mixing concrete as a user moves the device along a ground surface.

The general purpose of the present invention, which will be described subsequently in greater detail, is to provide a new concrete mixing device apparatus and method which has many of the advantages of the concrete mixers mentioned heretofore and many novel features that result in a new concrete mixing device which is not anticipated, rendered obvious, suggested, or even implied by any of the prior art concrete mixers, either alone or in any combination thereof.

To attain this, the present invention generally comprises a rolling drum with one of the ends of the rolling drum having an opening into the interior of the rolling drum. The device also includes a handle member having opposite first and second ends and a pair of arms. The arms are spaced apart from each other at the first end of the handle member. Each of the arms has a mounting pin extending therefrom that face one another. The rolling drum is interposed between the arms with each of the ends of the rolling drum rotationally mounted to an associated mounting pin to permit free rotation of the rolling drum. A pair of hand grips are extended from the second end of the handle member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new concrete mixing device apparatus and method which has many of the advantages of the concrete mixers mentioned heretofore and many novel features that result in a new concrete mixing device which is not anticipated, rendered obvious, suggested, or even implied by any of the prior art concrete mixers, either alone or in any combination thereof.

It is another object of the present invention to provide a new concrete mixing device which may be easily and efficiently manufactured and marketed.

It is a further object of the present invention to provide a new concrete mixing device which is of a durable and reliable construction.

An even further object of the present invention is to provide a new concrete mixing device which is susceptible of a low cost of manufacture with regard to both materials and labor, and which accordingly is then susceptible of low prices of sale to the consuming public, thereby making such concrete mixing device economically available to the buying public.

Still yet another object of the present invention is to provide a new concrete mixing device which provides in the apparatuses and methods of the prior art some of the advantages thereof, while simultaneously overcoming some of the disadvantages normally associated therewith.

Still another object of the present invention is to provide a new concrete mixing device for mixing concrete as a user moves the device along a ground surface.

Yet another object of the present invention is to provide a new concrete mixing device which includes a rolling drum with one of the ends of the rolling drum having an opening into the interior of the rolling drum. The device also includes a handle member having opposite first and second ends and a pair of arms. The arms are spaced apart from each other at the first end of the handle member. Each of the arms has a mounting pin extending therefrom that face one another. The rolling drum is interposed between the arms with each of the ends of the rolling drum rotationally mounted to an associated mounting pin to permit free rotation of the rolling drum. A pair of hand grips are extended from the second end of the handle member.

Still yet another object of the present invention is to provide a new concrete mixing device that mixes cement as it is rolled on a ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic sectional view taken from line 3—3 of FIG. 1 of the locking assembly of the present invention.

FIG. 4 is a schematic sectional view of the measuring cup attached to the handle member of the present invention.

DESCRIPTION OF THE PREFERRED EMBODIMENT

Figure 1:
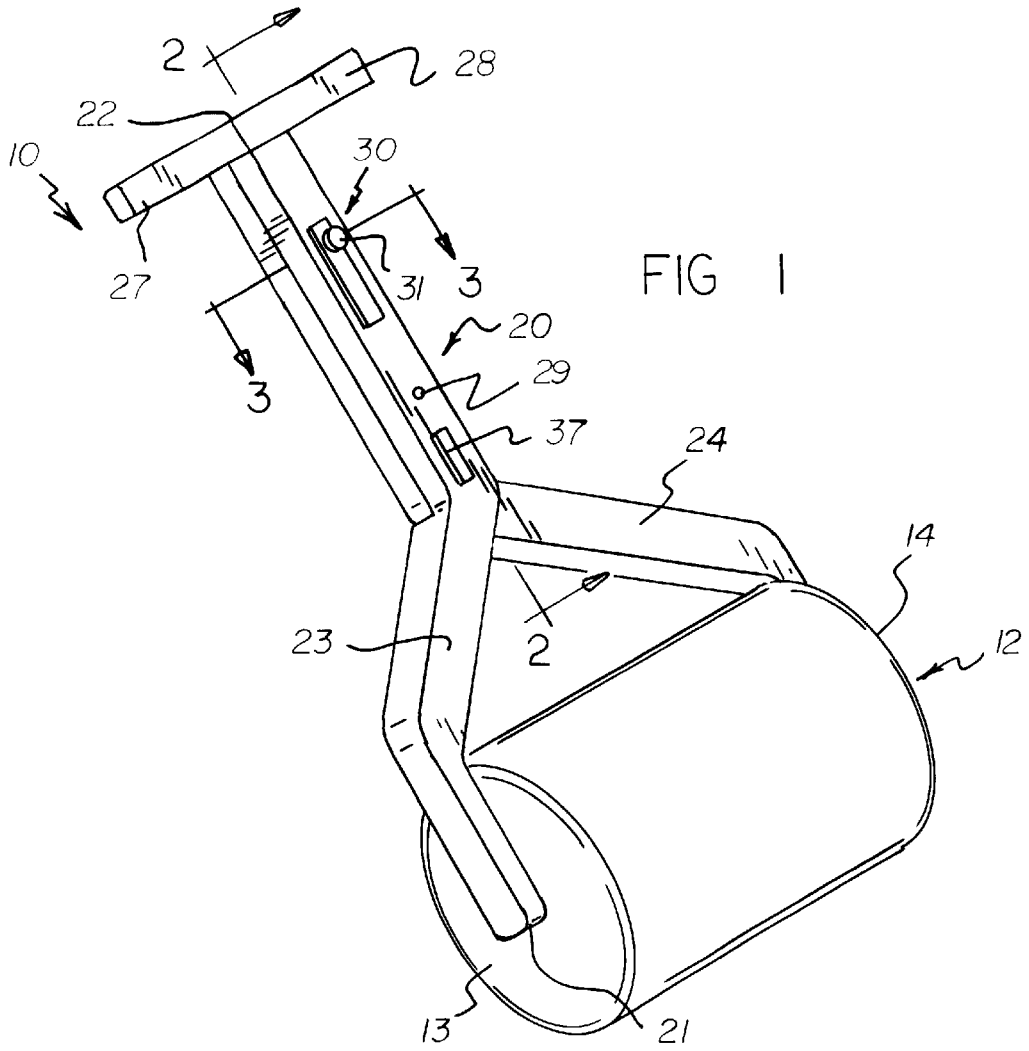
FIG. 1 is a schematic perspective view of a new concrete mixing device according to the present invention.

With reference now to the drawings, and in particular to FIGS. 1 through 9 thereof, a new concrete mixing device embodying the principles and concepts of the present invention and generally designated by the reference numeral 10 will be described.

As best illustrated in FIGS. 1 through 9, the concrete mixing device 10 generally comprises a rolling drum 12 with one of the ends 14 of the rolling drum 12 having an opening 17 into the interior of the rolling drum 12. The device also includes a handle member 20 having opposite first and second ends 21,22 and a pair of arms 23,24. The arms 23,24 are spaced apart from each other at the first end 21 of the handle member 20. Each of the arms 23,24 has a mounting pin 25,26 extending therefrom that face one another. The rolling drum 12 is interposed between the arms 23,24 with each of the ends 13,14 of the rolling drum 12 rotationally mounted to an associated mounting pin 25,26 to permit free rotation of the rolling drum 12. A pair of hand grips 27,28 are extended from the second end 22 of the handle member 20.

In use, the device 10 permits a user to mix concrete as it is transported to a work site in the device 10. This device functions as a lightweight replacement to a wheelbarrow or a cement tub. In closer detail, the rolling drum 12 is generally cylindrical and has an interior and a pair of opposite generally circular ends 13,14. The interior of the rolling drum 12 is designed for holding a volume of unset concrete therein. The interior of the rolling drum 12 preferably has a pair of elongate mixing blades 15,16 therein. One of the mixing blades 16 is extended from one of the ends 13 of the rolling drum 12 towards the other of the ends 12 of the rolling drum 12 while another of the mixing blades 15 is extended from the other of the ends 14 of the rolling drum 12 towards the one of the ends 13 of the rolling drum 12. The mixing blades 15,16 are designed for aiding mixing of concrete in the interior of the rolling drum 12.

Figure 5:
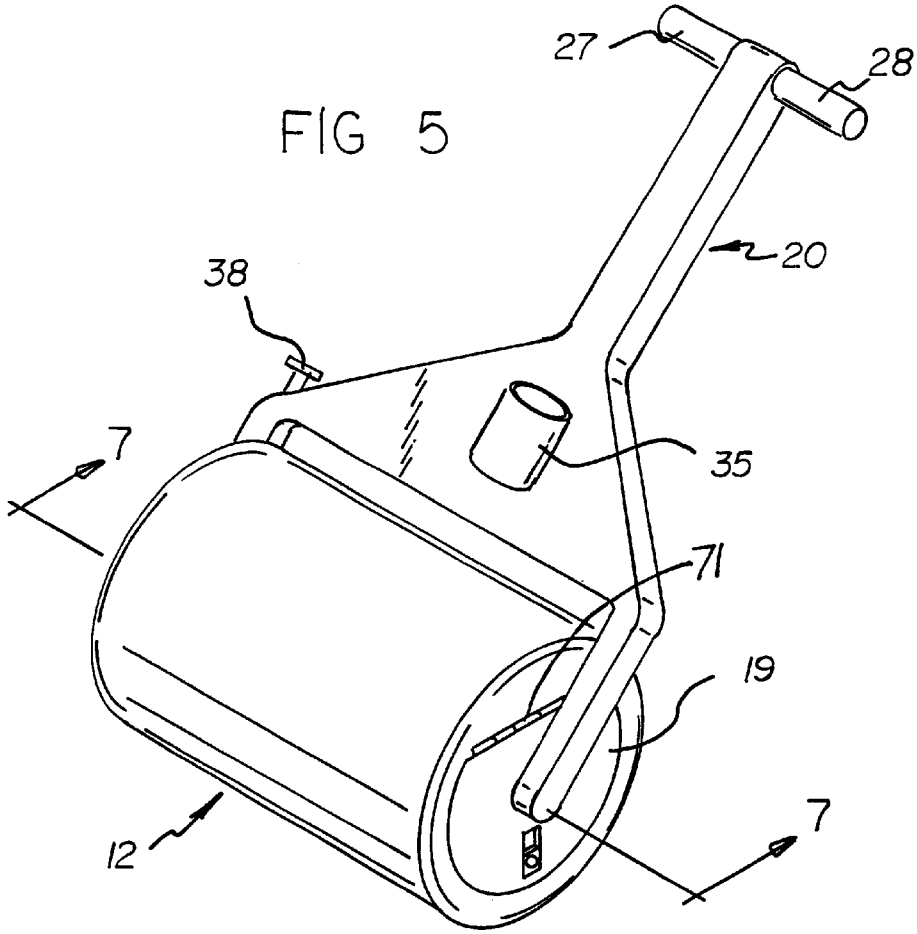
FIG. 5 is a schematic perspective view of an optional embodiment of the present invention.
Figure 6:
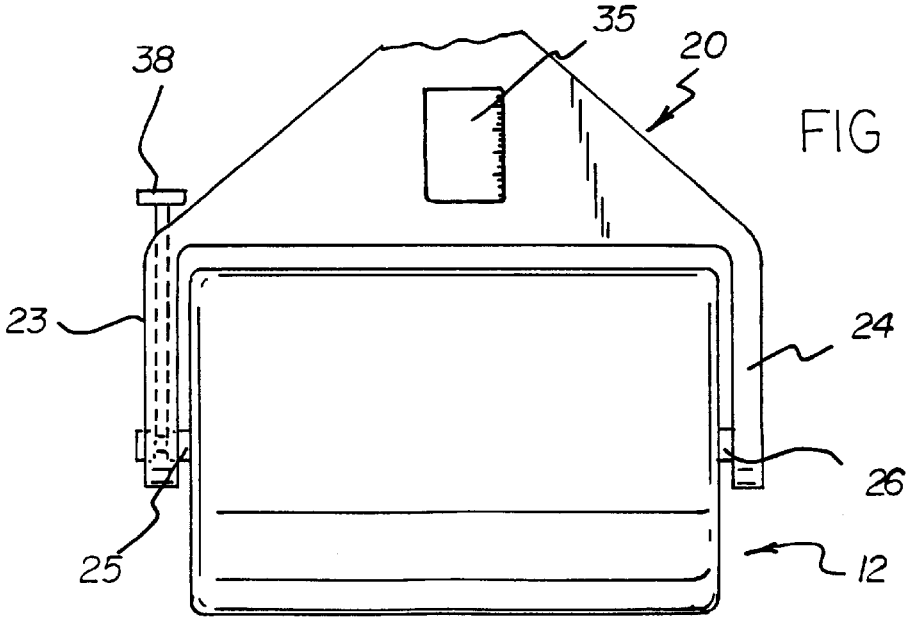
FIG. 6 is a schematic partial front side view of the optional embodiment of the present invention.
Figure 8:
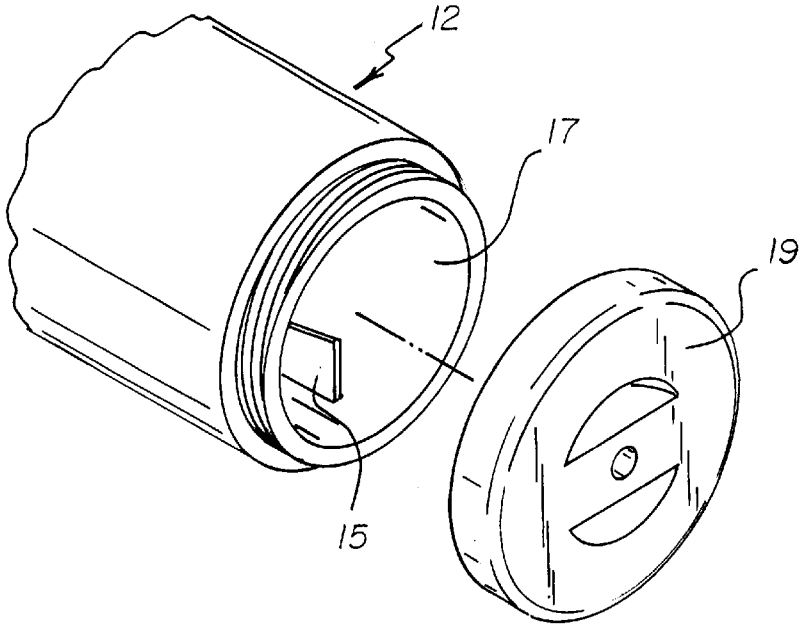
FIG. 8 is a schematic partial perspective view of the rolling drum of the present invention having the threaded closure.

One of the ends 14 of the rolling drum 12 has an opening 17 into the interior of the rolling drum 12. This end 14 of the rolling drum 12 has a closure or hatch for the opening 17 of the one end of the rolling drum 12. As illustrated in FIG. 8, the closure 18 may be threadably attached to the rolling drum 12. Optionally, as illustrated in FIG. 5, the closure may be hingedly attached to the rolling drum 12.

Figure 7:
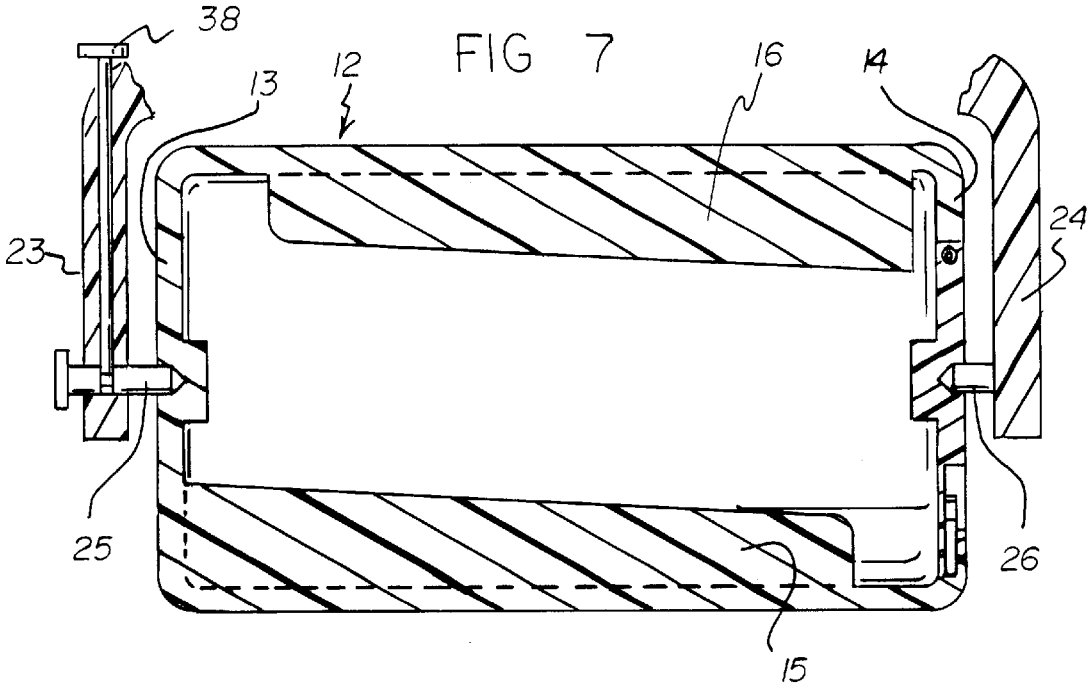
FIG. 7 is a schematic sectional view of the rolling drum of the present invention as seen from line 7—7 of FIG. 5.

The handle member 20 has opposite first and second ends 21,22, and a pair of arms 23,24. The arms 23,24 are spaced apart from each other at the first end 21 of the handle member 20. Each of the arms 23,24 has a mounting pin 25,26 extending therefrom which face one another. The rolling drum 12 is interposed between the arms 23,24 with each of the ends 13,14 of the rolling drum 12 rotationally mounted to an associated mounting pin 25,26 to permit free rotation of the rolling drum 12. That is one of the ends of the rolling drum 12 is rotationally mounted to one of the mounting pins and the other end of the rolling drum 12 is rotationally mounted to the other mounting pin. A pair of hand grips 27,28 are extended in opposite directions from the second end 22 of the handle member 20. Optionally, as illustrated in FIGS. 5 and 7, a release pin 38 may be provided for holding one of the mounting pins to its associated arm. Removal of the release pin 38 permits removal of the rolling drum 12 from between the arms 23,24 of the handle member 20.

Figure 2:
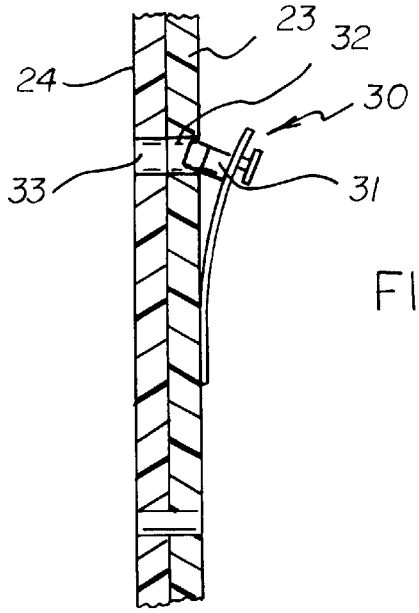
FIG. 2 is a schematic sectional view taken from line 2—2 on FIG. 1 of the locking assembly of the present invention.
Figure 9:
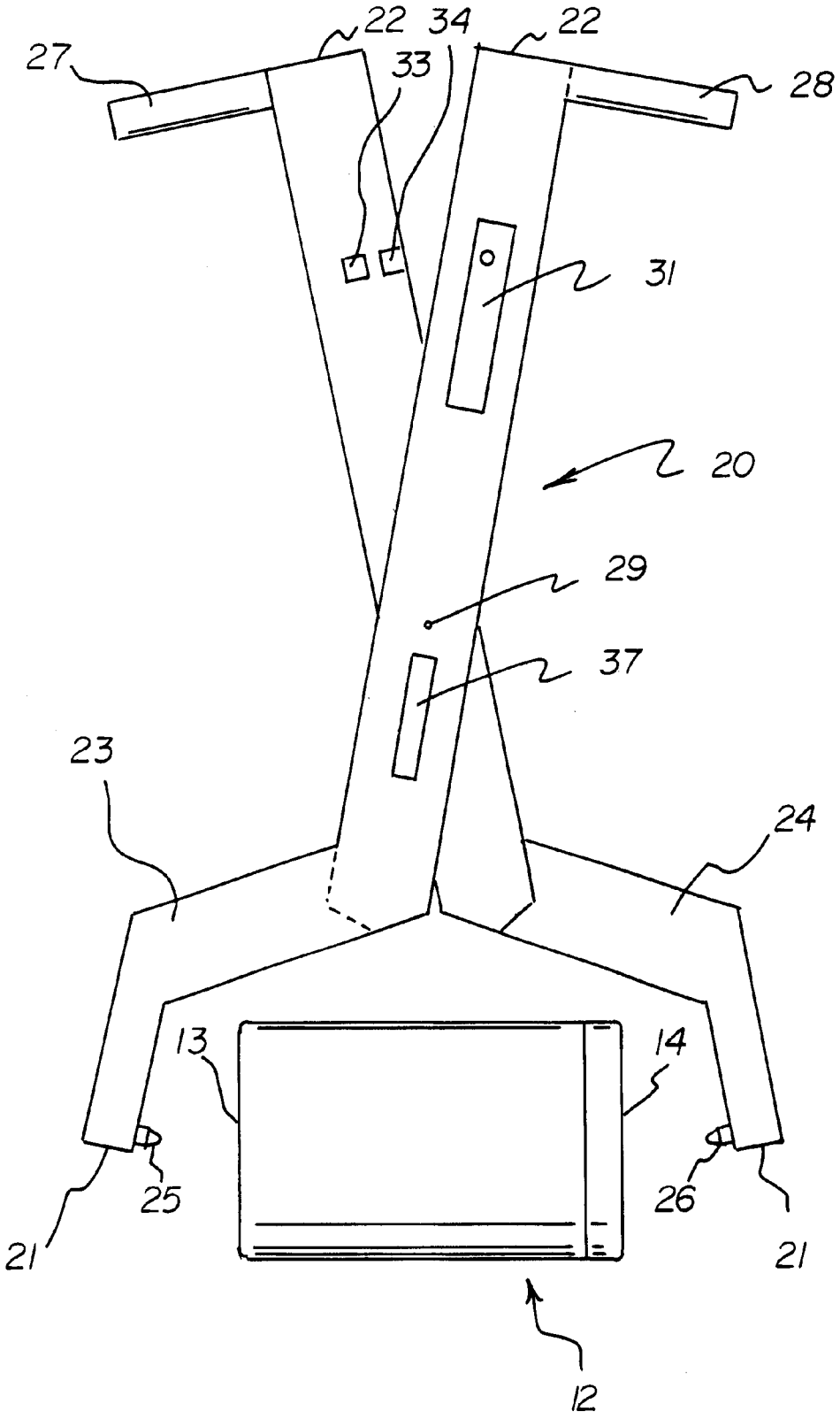
FIG. 9 is a schematic side view of the present invention with the arms pivoted apart.

Preferably, as illustrated in FIGS. 1 and 9, the arms 23,24 of the handle member 12 are pivotally coupled together at a pivot point 29 between the first and second ends 21,22 of the handle member 20. One of the arms has one of the hand grips coupled thereto while the other arm has the other hand grip coupled thereto. A locking assembly 30 is provided for holding the arms 23,24 together such that the lengths of the arms 23,24 are generally parallel with each other. The locking assembly 30 is preferably positioned between the second end 22 of the handle member 20 and the pivot point 29 of the arms 23,24. As illustrated in FIGS. 2 and 3, the locking assembly 30 comprises a latch pin 31 and a pair of bores 32,33. One of the bores is extended through a first of the arms while the other of the bores is extended into a second of the arms 23,24. The bores 32,33 are coaxial when the lengths of the arms 23,24 are generally parallel. The latch pin 31 is coupled to the first of the arms and is insertable into the bores 32,33 when the bores 32,33 are coaxial. Optionally, a notch 34 is provided in the second of the arms into which the latch is insertable into. Preferably, the lengths of the hand grips 27,28 are coaxial when the lengths of the arms 23,24 are generally parallel. Ideally, the hand grips 27,28 lie in a common plane so that the hand grips 27,28 are coplanar when the lengths of the arms 23,24 are generally parallel.

Preferably, a measuring cup 35 is detachably attached to the handle member 20 between the first end 21 of the handle and the pivot point 29 of the arms 23,24. The measuring cup 35 has a slot 36 while one of the arms has a mounting bracket 37 which is received by the slot to detachably attach the measuring cup 35 to the arm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for mixing concrete, comprising:

a rolling drum being generally cylindrical and having an interior, and a pair of opposite generally circular ends;

one of said ends of said rolling drum having an opening into said interior of said rolling drum, the one end of said rolling drum having a closure for said opening of the one end of said rolling drum;

a handle member having opposite first and second ends, and a pair of arms;

said arms being spaced apart from each other at said first end of said handle member, each of said arms having a mounting pin extending therefrom, said mounting pins facing one another;

said rolling drum being interposed between said arms, each of said ends of said rolling drum being rotationally mounted to an associated mounting pin to permit free rotation of said rolling drum;

a pair of hand grips being extended from said second end of said handle member: and wherein said arms of said handle are pivotally coupled together at a pivot point between said first and second ends of said handle member, one of said arms having one of said hand grips, another of said arms having another of said hand grips.

2. The device of claim 1, wherein said interior of said rolling drum has a pair of elongate mixing blades therein.

3. The device of claim 2, wherein one of said mixing blades is extended from one of said ends of said rolling drum towards the other of said ends of said rolling drum, another of said mixing blades is extended from the other of said ends of said rolling drum towards the one of said ends of said rolling drum.

4. The device of claim 1, wherein said closure is threadably attached to said rolling drum.

5. The device of claim 1, wherein said closure is hingedly attached to said rolling drum.

6. The device of claim 1, further comprising a locking assembly for holding said arms together such that the lengths of said arms are generally parallel with each other.

7. The device of claim 6, wherein said locking assembly comprises a latch pin and a pair of bores, one of said bores being extended through a first of said arms, the other of said bores being extended into a second of said arms, said bores being coaxial when the lengths of said first of said arms, are generally parallel, said latch pin being coupled to said first of said arms, said latch pin being insertable into said bores when said bores are coaxial.

8. The device of claim 6, wherein the lengths of said hand grips are coaxial when the lengths of the arms are generally parallel.

9. The device of claim 1, further comprising a measuring cup being detachably attached to said handle member.

10. The device of claim 9, said measuring cup having a slot, one of said arms having a mounting bracket, said slot receiving said mounting bracket to detachably attach said measuring arm.

11. A device for mixing concrete, comprising:

a rolling drum being generally cylindrical and having an interior, and a pair of opposite generally circular ends;

said interior of said rolling drum having a pair of elongate mixing blades therein, one of said mixing blades being extended from one of said ends of said rolling drum towards the other of said ends of said rolling drum, another of said mixing blades being extended from the other of said ends of said rolling drum towards the one of said ends of said rolling drum;

one of said ends of said rolling drum having an opening into said interior of said rolling drum, the one end of said rolling drum having a closure for said opening of the one end of said rolling drum, said closure being threadably attached to said rolling drum;

a handle member having opposite first and second ends, and a pair of arms;

said arms being spaced apart from each other at said first end of said handle member, each of said arms having a mounting pin extending therefrom, said mounting pins facing one another;

said rolling drum being interposed between said arms, each of said ends of said rolling drum being rotationally mounted to an associated mounting pin to permit free rotation of said rolling drum, one of said ends of said rolling drum being rotationally mounted to one of said mounting pins, another of said ends of said rolling drum being rotationally mounted to the other of said mounting pins;

a pair of hand grips being extended in opposite directions from said second end of said handle member;

said arms of said handle being pivotally coupled together at a pivot point between said first and second ends of said handle member, one of said arms having one of said hand grips, another of said arms having another of said hand grips;

a locking assembly for holding said arms together such that the lengths of said arms are generally parallel with each other, said locking assembly comprising a latch pin and a pair of bores, one of said bores being extended through a first of said arms, the other of said bores being extended into a second of said arms, said bores being coaxial when the lengths of said arms are generally parallel, said latch pin being coupled to said first of said arms, said latch pin being insertable into said bores when said bores are coaxial;

said hand grips being coaxial when the lengths of the arms are generally parallel, said hand grips lying in a common plane;

a measuring cup being detachably attached to said handle member, said measuring cup having a slot, one of said arms having a mounting bracket, said slot receiving said mounting bracket to detachably attach said measuring cup to said arm.

* * * * *